US006066010A

United States Patent [19]

Wulff

[11] Patent Number: 6,066,010

[45] Date of Patent: May 23, 2000

[54] CABLE PLUG-IN CONNECTOR WITH CONTACT TONGUES PROVIDED WITH SOLDERED CONNECTIONS AND SECURED IN AN INSULATING BODY

[75] Inventor: W.-Peter Wulff, Upton, Mass.

[73] Assignee: Siemens Aktiengesellschaft, Munich, Germany

[21] Appl. No.: 09/171,650

[22] PCT Filed: Apr. 15, 1997

[86] PCT No.: PCT/DE97/00755

§ 371 Date: Oct. 22, 1998

§ 102(e) Date: Oct. 22, 1998

[87] PCT Pub. No.: WO97/40552

PCT Pub. Date: Oct. 30, 1997

[30] Foreign Application Priority Data

Apr. 22, 1996 [DE] Germany ..... 196 15 979

[51] Int. Cl.[7] ..... H01R 4/02

[52] U.S. Cl. ..... 439/874; 439/736

[58] Field of Search ..... 439/874, 736

[56] References Cited

U.S. PATENT DOCUMENTS

| | | | |
|---|---|---|---|
| 4,772,228 | 9/1988 | Seymour | 439/865 |
| 4,781,620 | 11/1988 | Tengler et al. | 439/497 |
| 4,854,894 | 8/1989 | Harrell | 439/736 |
| 4,920,642 | 5/1990 | Yanai et al. | 439/874 |
| 5,120,268 | 6/1992 | Gerrans | 439/736 |
| 5,330,372 | 7/1994 | Pope et al. | 439/692 |

FOREIGN PATENT DOCUMENTS

| | | |
|---|---|---|
| 0 054 854 | 6/1982 | European Pat. Off. . |
| 2 618 614 | 1/1989 | France . |
| 34 43 888 | 5/1986 | Germany . |

*Primary Examiner*—Gary F. Paumen
*Attorney, Agent, or Firm*—Hill & Simpson

[57] ABSTRACT

A cable connector is proposed having an insulation body and having a plurality of electrical contact tracks which are fixed in the insulation body with an end on the plug side being designed as a contact element for producing an electrical contact with a mating connector and with an opposite end being designed as a solder connection for a cable conductor. The solder connection is intended to have a V-shaped cross-section, and a rear side, which faces away from the cable conductor, is intended to be embedded in the insulation body by extrusion coating with plastic.

2 Claims, 1 Drawing Sheet

CABLE PLUG-IN CONNECTOR WITH CONTACT TONGUES PROVIDED WITH SOLDERED CONNECTIONS AND SECURED IN AN INSULATING BODY

BACKGROUND OF THE INVENTION

The invention relates to a cable connector having an insulation body and having a plurality of electrical contact tracks which are fixed in the insulation body. Each contact track has an end on the plug side, which is designed as a contact element for producing an electrical contact with a mating connector, and has an opposite end, which is designed as a solder connection for a cable conductor.

Such plug connectors have also been disclosed and are of interest, in particular, in the context of the standardized USB (Universal Serial Bus) concept which is the aim of a number of computer manufacturers. This new bus system relates in principle to the connections of peripherals to a PC no longer being carried out, as in the past, via individual parallel connections with separate and frequently different connector systems, but by the peripherals essentially being connected in serial to a common bus line which is directly connected to a printed circuit board (motherboard) in the PC via a standardized plug socket on the housing of the PC. The plug face of the printed circuit board plug socket or receptacle has essentially already been defined by a specification and has four contact springs which are located in a plane alongside one another, are in the form of a strip and, when the bus plug is inserted, interact and produce the electrical contact with the four contact rails or tracks which are arranged in the plug and are located alongside one another. The contact springs are arranged in the female connector in an insulation body which essentially has a plastic tongue having a rectangular cross-section, and are bent in their rear region to form connecting legs which point away downwards and can be inserted into contact holes in the printed circuit board. The connector and mating connector are normally provided with a metallic screening housing. Two latching hooks are provided in each case in the top region and bottom region of these screening plates, engage in cutouts on the screening housing of the matching mating connector, and produce the retaining forces when the plug is withdrawn and the earthing contact.

The solder connections of the previous cable connectors are normally designed as flat sheet-metal elements which project out of the insulation body and are accordingly essentially not touched or supported by the insulation body. This known solution has both design and thermal disadvantages.

SUMMARY OF THE INVENTION

The present invention is based on the object of improving the known cable connector, with regard to the indicated disadvantages.

In the case of a cable connector of the type mentioned initially, this object is achieved in that the solder connection has a V-shaped cross-section, and its rear side, which faces away from the cable conductor, is embedded in the insulation body by extrusion coating with plastic.

DESCRIPTION OF THE PREFERRED EMBODIMENTS

Figure 1:
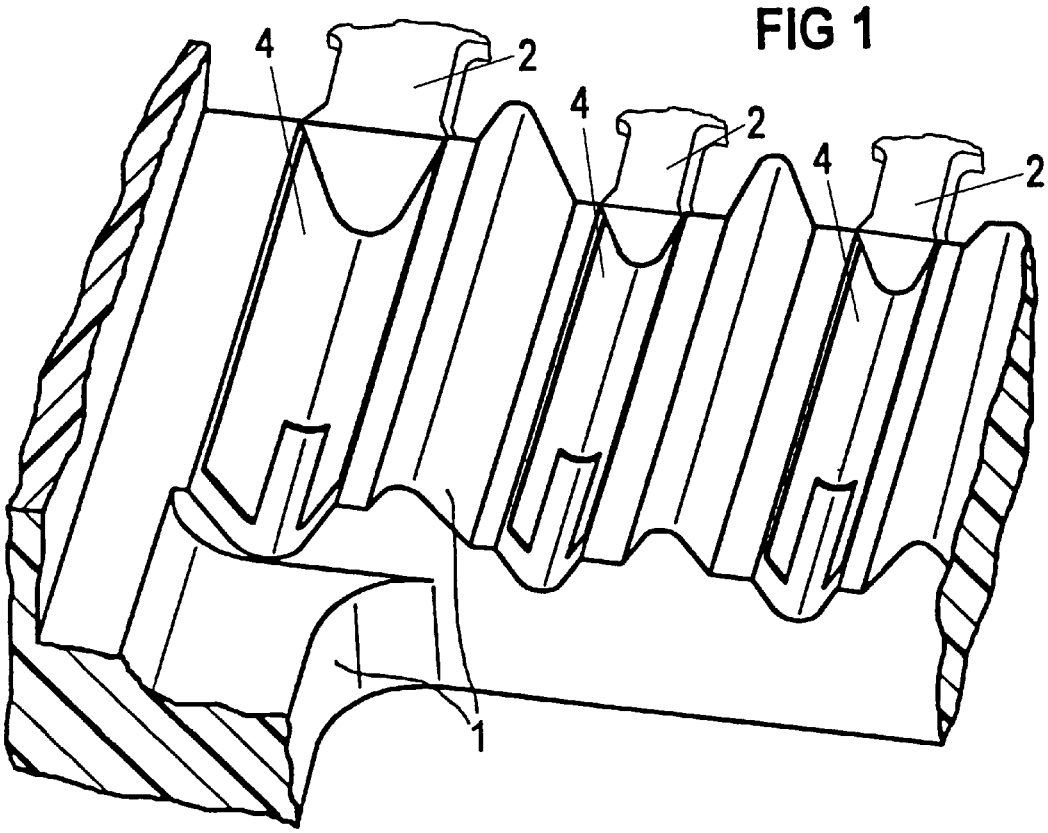
FIG. 1 is a perspective partial view of a cable connector according to the invention, whose solder connections have not yet been provided with cable conductors.

FIG. 1 shows an insulation body 1 which is injection moulded from plastic material and in which, for example, four contact tracks 2, which are located along-side one another, are embedded (only three can be seen). The contact elements of the contact tracks have been omitted in the chosen illustration in the lower part of the figure.

Figure 2:
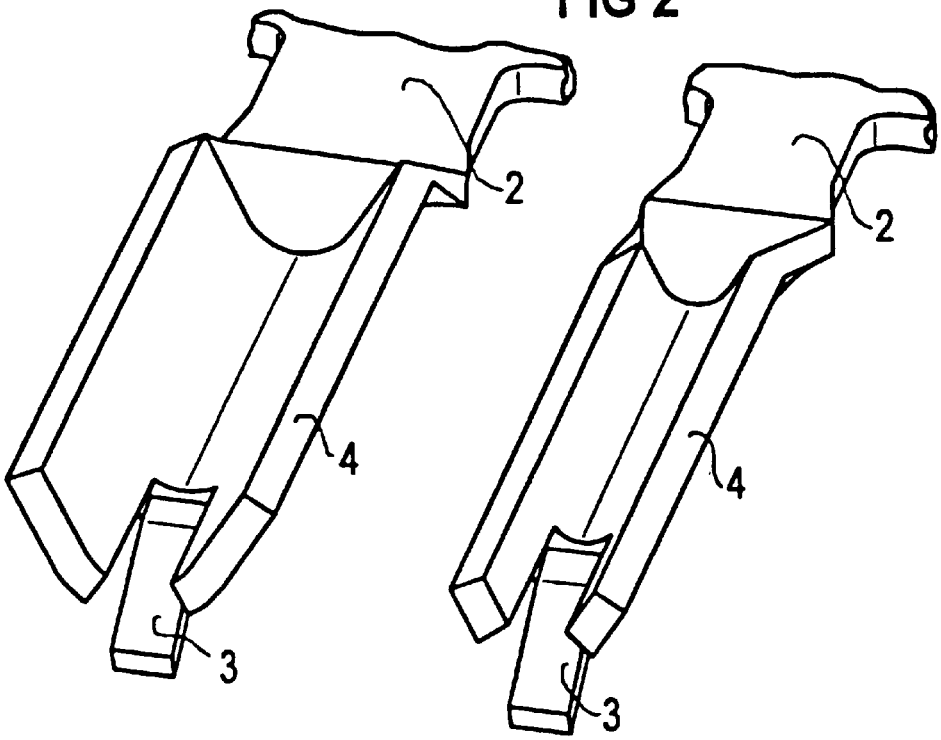
FIG. 2 is a partial perspective view from the rear side of the solder connections of the cable connector according to FIG. 1, and the solder connections have not yet been embedded in the insulation body.

The V-shape channel with a concave surface and a convex surface of the solder connections according to the invention is best seen in FIG. 2. The V-shape of the solder connections has the advantage that a larger wetting area of the concave surface is available when soldering the cable conductors which must be inserted lengthwise into the solder connections 4 from above in FIG. 1. The cable conductor is virtually completely surrounded by the solder tin. During the soldering process, the V-shape results in the cable conductor being prepositioned in an advantageous manner. The V-shape furthermore also makes it possible for the solder connection 4 to be embedded or extrusion coated easily during the injection moulding of the insulation body 1. As is best seen in FIG. 1, it is directly possible to embed the solder connection 4 in the insulation body 1 to such an extent that the convex surface or rear side, which faces away from the cable conductor, is completely surrounded by the plastic material. The embedding on the one hand provides better mechanical robustness and fixing of the contact tracks 2 in the insulation body 1. However, above all, the embedding results in relatively better heat transmission from the solder connection 4 to its environment during the soldering process. This is advantageous during production, for example in order to prevent the insulation body 1 from melting during the soldering process.

It is advantageous to provide a stepped lug 3 at the cable-side end of the solder connection 4 in order that the contact track end is anchored particularly firmly in the plastic materials. Each lug 3 also produces additional security against any displacement caused, for example, by thermal stresses during the soldering process.

What is claimed is:

1. A cable connector having an insulation body with a plug side and having a plurality of electrical contact tracks being fixed in the insulation body, each contact track having one end extending from the plug side being designed as a contact element for producing electrical contact with a mating connector and having an opposite end being designed as a solder connection for a cable conductor, each solder connection being embedded in the insulating material and having a channel with a V-shaped cross-section being exposed for forming a connection with the cable conductor.

2. A cable connector according to claim 1, wherein each solder connection includes a tab bent out of the V-shaped cross-section.

* * * * *